United States Patent [19]

Gerber

[11] Patent Number: 4,707,862

[45] Date of Patent: Nov. 24, 1987

[54] CONVERTIBLE OUTERWEAR GARMENT

[75] Inventor: Terry L. Gerber, South Bend, Ind.

[73] Assignee: Ashley Worldwide, Inc., Mishawaka, Ind.

[21] Appl. No.: 16,330

[22] Filed: Feb. 19, 1987

[51] Int. Cl.[4] ..... A41D 1/00

[52] U.S. Cl. ..... 2/93

[58] Field of Search ..... 2/93, 94, 88, 85, 86, 2/69, 102, 108

[56] References Cited

U.S. PATENT DOCUMENTS

| | | | |
|---|---|---|---|
| 1,829,871 | 11/1931 | Morck | 2/94 |
| 2,123,969 | 7/1938 | Rosenblatt | 2/93 |
| 2,320,783 | 6/1943 | Lee | 2/94 |
| 2,349,035 | 5/1944 | Falcon | 2/94 |
| 2,437,223 | 3/1948 | Dutrow | 2/94 |
| 3,085,250 | 4/1963 | Finlay | 2/102 |
| 3,389,407 | 6/1968 | Morrison | 2/86 |
| 4,217,663 | 8/1980 | Goldberg et al. | 2/86 |
| 4,232,402 | 11/1980 | Locke | 2/102 |
| 4,573,218 | 3/1986 | Saggs | 2/93 |

*Primary Examiner*—Doris L. Troutman

*Attorney, Agent, or Firm*—Barnes & Thornburg

[57] ABSTRACT

A garment for use as either a short jacket or a long coat is provided with a circumferential lower extension portion that is detachable from the upper jacket portion. The lower extension portion may also be folded and secured to the inside back jacket panel, preventing unsightly bulkiness in the front and sides of the jacket when the extension portion is in a folded position and the garment is worn as a short jacket.

9 Claims, 3 Drawing Figures

CONVERTIBLE OUTERWEAR GARMENT

BACKGROUND AND SUMMARY OF THE INVENTION

The present invention relates to a convertible length garment which has a detachable extension portion. The garment may be worn as a short jacket, or the extension portion may be extended from the bottom of the jacket so that the jacket is converted to a long coat.

Coats which are convertible in length are known in the prior art. (See U.S. Pat. Nos. 4,573,218; 4,232,402; 2,349,035; 2,320,783; and 2,437,223, for example.) However, when the extension portion is circumferential, the prior art provides only for circumferential folding of the extension portion (U.S. Pat. Nos. 4,573,218 and 2,349,035). Thus, the sides and front of the garment are made bulkier and less attractive when the garment is worn as a short jacket with the extension portion folded inside. Further, prior art convertible jackets which have circumferential extension portions are inflexible in that they were either designed to be completely detached from the jacket door to be folded into the jacket, but were not designed to accommodate both uses as desired by the wearer.

An objective of the present invention is to overcome these disadvantages, by providing a jacket having a detachable, circumferential extension portion which is easily folded so that the garment can be converted simply from a long coat to a short jacket.

Another objective is to provide an outerwear garment having an extension portion which is also easily detachable from the jacket portion.

A further objective of the present invention is to provide a jacket that does not have unsightly bulkiness on the front and sides of the jacket when the extension portion is folded into the jacket.

These and other objectives are attained in the present invention by providing a jacket with an upper body portion having a lower end and a back jacket panel, and a lower extension portion having at least two extension panels. The lower extension portion is detachably connected to the upper body portion lower end such that the lower extension portion forms a circumferential extension of the upper body portion in an unfolded position.

In certain preferred embodiments, the lower extension portion has two side extension panels and a center extension panel. Both of the side extension panels are folded onto the center extension panel, and the panels are then folded against the back jacket panel. A feature of certain preferred embodiments are the use of hook and loop fasteners for securing the side extension panels to the center extension panel and all of the extension panels to the back jacket panel when they are placed into the folded position. The hook and loop fasteners provide quick and easy fastening of the side extension panels to the center extension panel so that the extension portion may be folded as a unit and secured to the back jacket panel.

By providing a multi-panel extension, with the panels foldable onto each other, which are then folded onto the back jacket panel, a jacket is provided which will not have unsightly bulkiness on its front and sides when the extension portion is folded into the upper jacket portion. Further, the garment construction allows for either complete detachment of the extension portion, or carrying of the extension portion folded into the jacket without detracting from the aesthetic qualities of the jacket.

Further objects, features, and advantages of the present invention will become more apparent from the following description and the accompanying drawings, which depict for purposes of illustration only, a preferred embodiment constructed in accordance with the present invention.

DETAILED DESCRIPTION OF THE DRAWINGS

Figure 1:
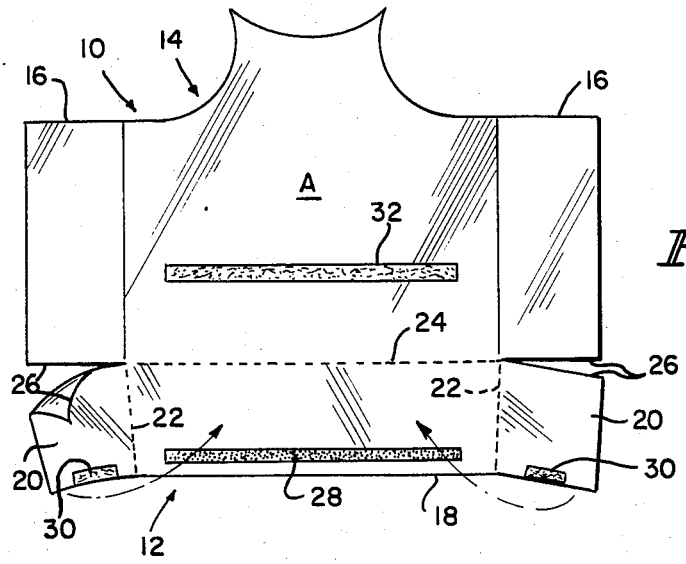
FIG. 1 is a partial view of the garment constructed in accordance with a preferred embodiment of the invention with the extension portion in an unfolded position.

FIG. 1 shows a portion of the inside surfaces of the garment. The jacket has two main portions, the upper body portion 10 and the lower extension portion 12. The upper body portion 10 has a back jacket panel 14 and two side panels 16.

The lower extension portion 12 has, in preferred embodiments, three extension panels. As shown in FIG. 1, the lower extension portion has a center extension panel 18 between two side extension panels 20. The lower extension portion 12 is of unitary construction in preferred embodiments.

The jacket is shown in FIG. 1 in the unfolded position. The lower portion 12 is attached to the upper body portion 10 by connecting means, which in the illustrated embodiment, are three zippers. The center panel A is connected by zipper 24, while the side panels 20 are connected to the jacket side panels 16 by zippers 26. As can be seen from the illustration of FIG. 1, the zippers 24, 26 are actuable independently of one another. This allows the center extension panel 18 to still be connected to the back jacket panel 14 while the side panels 20 are detached from the jacket side panels 16.

The lower extension portion 12 may be completely detached from the upper body portion 10, so that the garment is then worn as a short jacket.

Figure 2:
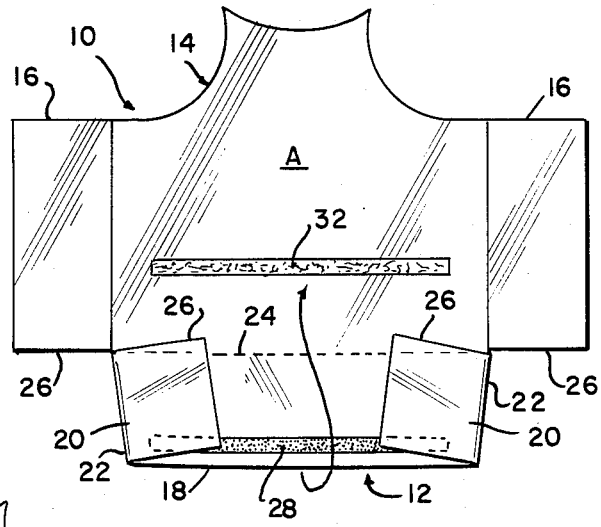
FIG. 2 shows the embodiment of FIG. 1 in an intermediary folded position.

The independent detachability of the extension panels allows the side panels 20 to be folded onto the center extension panel 18. When folding of the lower extension portion 12 is desired, the two side extension panels 20 are released from the jacket side panels 16 by activation of zippers 26 and folded along fold lines 22 onto the center extension panel 18. As can be seen from FIG. 2, which illustrates this intermediary folded position, in a preferred embodiment the side extension panels 20 are folded onto the center extension panel 18 at an angle. This angled folding allows a portion of the hook strip 28 to be exposed, to allow the hook strip 28 to engage the loop strip 32 on back jacket panel 14.

The lower extension portion 12 and side extension panels 20 are provided with a hook and loop fastener means to facilitate securement of the side extension panels 20 to the center extension panel 18. In the embodiment illustrated, the side extension panels 20 each have a loop portion 30 which cooperates with hook portion 28 on center extension panel 18. The hook and loop fasteners 28, 30 provide for quick and easy securement of the side extension panels 20 to the center extension panel 18.

Figure 3:
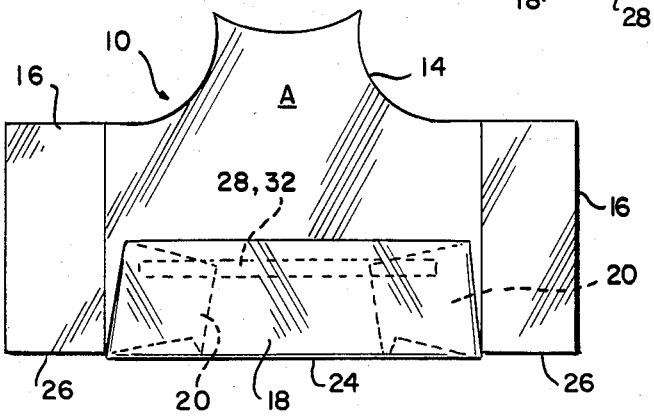
FIG. 3 shows the embodiment of FIG. 1 in a final folded position.

After the side extension panels 20 are folded onto the center extension panel 18, the center extension panel 18 may then be folded and secured to the inside of the back jacket panel 14. The center extension panel 18 is secured by the loop strip 32 attached to the inside of the back jacket panel 14 which cooperates with the hook strip 28 attached to the center extension panel 18. As noted above, a center portion of the hook strip 28 is still exposed after the side panels 20 are folded onto the center expansion panel 18. It is this center portion of the hook strip 28 which fastens the lower extension portion 12 to the back jacket panel 14 through engagement with loop strip 32. Thus, the lower extension portion 12 is quickly and easily secured to the back jacket panel 14. This final folded position is shown in FIG. 3. As this figure shows, the lower extension portion 12 is completely and securely folded and held to the inside back jacket panel 14 and does not extend into the side panels 16. Thus, when the lower extension portion 12 is in the folded position illustrated in FIG. 3, the garment can be worn as a short jacket without having bulky front and sides, while still carrying the extension portion 12 and the wearer, if desired, may quickly and easily convert the garment into a long coat.

Although the present invention has been described and illustrated in detail, it is to be clearly understood that the same is by way of illustration and example only, and is not to be taken by way of limitation. The spirit and scope of the present invention are to be limited only by the terms of the amended claims.

What is claimed is:

1. A jacket, comprising:

an upper body portion having back and side jacket panels;

a lower extension portion having at least two extension panels, at least one said extension panel being foldable onto another said extension panel; and first fastener means for releasably securing said lower extension portion to said back jacket panel in a folded position, and sub-connecting means for detachably connecting said lower extension portion to said upper body portion, such that said lower extension portion forms an extension of said upper body portion when connected to said upper body portion.

2. A jacket according to claim 1, wherein said lower extension portion has two side extension panels and a center extension panel.

3. A jacket according to claim 2, wherein each said side extension panel, and said center extension panel are detachably connected to said upper body portion lower end by separate connecting means.

4. A jacket according to claim 3, further comprising second fastening means for releasably securing said side extension panels to said center extension panel.

5. A jacket according to claim 4, wherein said first fastening means are hook and loop fasteners.

6. A jacket according to claim 5, wherein said second fastening means are hook and loop fasteners.

7. A jacket according to claim 6, wherein said first fastening means includes a portion of said second fastening means on said center extension panel.

8. A jacket according to claim 7, wherein said connecting means are zippers.

9. A jacket according to claim 1, wherein said first fastening means are hook and loop fasteners.

* * * * *